United States Patent [19]

Scott et al.

[11] Patent Number: 4,971,022

[45] Date of Patent: Nov. 20, 1990

[54] CUTTING CHAIN FOR AGGREGATE MATERIALS

[75] Inventors: Lewis A. Scott, Lake Oswego; John L. Edgerton, Canby; Johann Weber, Estacada, all of Oreg.

[73] Assignee: Blount, Inc., Portland, Oreg.

[21] Appl. No.: 512,841

[22] Filed: Apr. 23, 1990

[51] Int. Cl.[5] ..... B28D 1/08; B28D 1/12

[52] U.S. Cl. ..... 125/21; 125/22

[58] Field of Search ..... 125/21, 22; 83/830, 83/831, 832; 51/136, 206 R

[56] References Cited

U.S. PATENT DOCUMENTS 4,896,648 1/1990 Boller ..... 125/21

4,920,947 5/1990 Scott et al. ..... 125/22

FOREIGN PATENT DOCUMENTS 3332051 3/1984 Fed. Rep. of Germany ..... 125/21

*Primary Examiner*—Frederick R. Schmidt

*Assistant Examiner*—M. Rachuba

*Attorney, Agent, or Firm*—Robert L. Harrington

[57] ABSTRACT

A cutting saw chain for aggregate materials including a loop of articulated chain links adapted to fit the guide bar of a chain saw. The guide bar is provided with a flushing system whereby pressurized water is directed through the bar and into the path of the guided saw chain to cool the chain and flush away debris formed in the cutting operation. The cutting link structure is a folded plate-like member formed into spaced side plate portions and an overhead connecting web. The side plate portions function like side links in a conventional saw chain and ride on the rails of the guide bar. Rivet holes are formed in the side plate portions. Rivets projected through the rivet holes connect the side plate portions to front and rear center links. The side plate portions are fixed in spaced relation by the connecting web an permits the use of rivets with straight shank. The connecting web supports front and rear sections of a cutting block. An opening is provided between the front and rear cutting block sections and through the underlying connecting web to provide a passageway for directing the pressurized water through the chain and directly into the kerf being cut.

9 Claims, 1 Drawing Sheet

CUTTING CHAIN FOR AGGREGATE MATERIALS

BACKGROUND INFORMATION

1. Field of the Invention

This invention relates to cutting link structures particularly adapted for cutting aggregate materials.

2. Background of the Invention

A chain saw has many desirable features, e.g. as compared to a circular saw. However, as concerns the cutting of aggregate materials, the cutting chain and guide bar of the chain saw are far more fragile. The chain saw operation involves numerous parts that slide and pivot relative to each other. The cutting operation creates dust that tends to get between the sliding and pivoting bearing surfaces causing friction that far exceeds that of a wood cutting saw chain. This increased friction reduces the life of the saw chain to a fraction of a saw chain's life in a dust free environment, e.g. as experienced in wood cutting.

An important development for making chain saws commercially feasible for cutting aggregate is the provision of a flushing system for directing pressurized water through a channel network provided in the guidebar. The water is directed outwardly through the chain and between the chain links to reduce the presence of dust on these bearing surfaces. Such a system is disclosed in the commonly assigned U.S. patent application entitled "Chain Saw Components and System for Cutting Masonry and the Like", Ser. No. 181,437, filed 4/14/88. Whereas chain saws have made important inroads for aggregate cutting, the cost of Operating a chain saw under the severe aggregate cutting conditions remains many times greater than the more traditional operation of timber cutting. The present invention encompasses features that significantly contribute to improving the operation and reducing the operating costs of chain saws for such aggregate cutting.

BRIEF DESCRIPTION OF THE INVENTION

The present invention achieves three important benefits; it increases the chain's longevity by eliminating potential fracture lines; it maintains cutting stability and efficiency while reducing costs through reduction in use of diamond cutting chips; and it accomplishes both of the above while enhancing the ability of the flushing system to flush away the friction producing dust.

In the prior commercially successful chain disclosed in the U.S. patent application, Ser. No. 181,437, the cutting link was comprised of two separated side links with co-planer top edges. A diamond impregnated cutting block was attached to the top edges of the side links to form a unitized structure wherein the side links provided two supporting side plates of the structure with the cutting block bridging across the side plates. The block was secured to the top edges, e.g. by high tech welding. Nevertheless, the severe lateral forces that tend to work against the side links produces a severe strain on the weld joints and creates a potential fracture line. The preferred cutting link structure of the present invention is in the form of a high strength steel plate-like member, folded to form an inverted U shaped member that is itself a unitized structure having supporting side plates and a connecting web. The bowed connecting web is integral with the side plate portions and provides increased strength so that lateral forces are absorbed by the base member and not transferred through the cutting block as in the previous structure. The bottom surface of the cutting block is configured (curved) to match the web configuration and provides a substantial mated surface area for secure welding or brazing.

It has been determined through experience and experimentation that, whereas a long cutting block extending the length of the supporting side links is desirable to maintain cutting stability, that same stability can be achieved by placing partial cutting block sections at the front and rear of the supporting side links. Experimentation has also shown that the front and rear sections of the typical cutting block produces most of the cutting action and the useful life of the cutting block is expended when the diamond cutting chips of the front and rear sections are totally used up. Much of the diamond cutting chips that are located in the center section of the cutting block goes unused. It was accordingly determined that very little of the cutting chains cutting efficiency is lost by removing the center section of the cutting block.

With the above arrangement, because fewer diamond chips are required, a less expensive cutting chain for aggregate cutting is produced. More importantly, the center of the cutting link structure can be opened, i.e. by removing a middle section of the connecting web, to enable high pressure water to flow directly through the cutting link structure. The flushing of the dust is more effective and the wear from dust-induced friction is beneficially reduced.

The invention will be more fully appreciated with reference to the following detailed description and drawings wherein.

Figure 1:
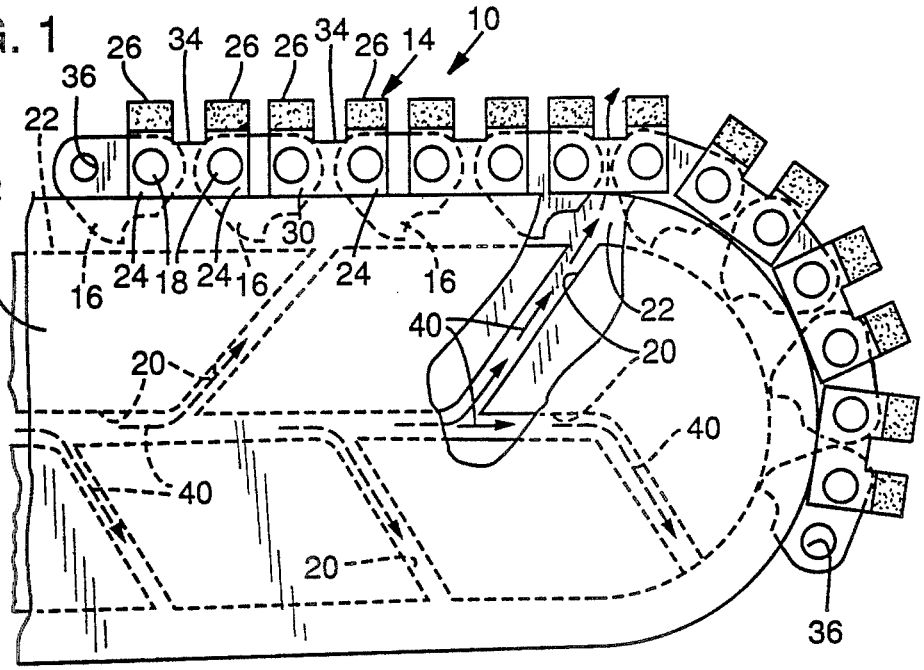
FIG. 1 is a partial side view of a saw chain in accordance with the present invention, the saw chain being mounted on a guide bar of a chain saw adapted for cutting aggregate materials.

Referring to FIG. 1 of the drawings, a chain saw power head (not shown) drives a continuous loop of saw chain 10 around a guide bar 12. The saw chain 10 includes cutting link structures 14 and center links 16 that are pivotally interconnected by rivets 18. The guide bar is of the type described in the above-mentioned commonly assigned patent application and will not be here described in detail. In general, a water channel system 20 directs a flow of pressurized water from an inlet at the rear of the bar, through the length of the bar and into the guide slot 22 (see FIG. 3) at spaced positions around the bar edge periphery.

Figure 2:
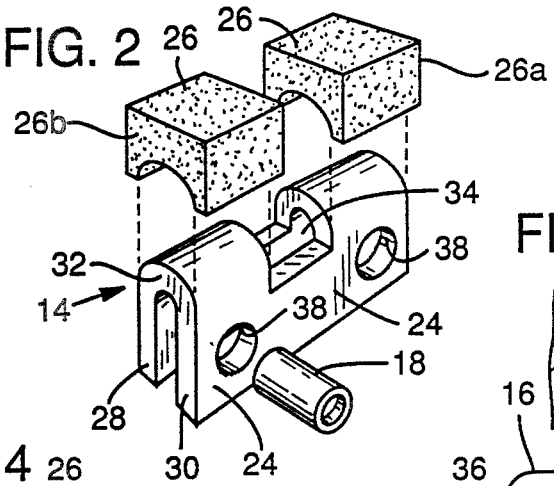
FIG. 2 is a perspective view of the cutting link structure of the saw chain of FIG. 1 with the components thereof in exploded view.

Reference is now made to the exploded view of the cutting link structure 14 illustrated in FIG. 2. The cutting link structure includes a base member 24, cutting block 26 including front section **26*a* and rear section 26*b* and the previously mentioned rivets 18. The base member is a plate-like member folded into an inverted U shape with legs 28, 30 of the base member replacing the prior side links, and the bowed connecting web 32** providing the support surface for the cutting block.

A center section of the connecting web 32 is removed to provide an opening 34. Cutting block sections **26*a*, 26*b* are configured with flat tops and concave bottom surfaces that match the convex top surface of the bowed connecting web 32. The cutting block sections 26a, 26b are secured to the connecting web as by welding or brazing, at positions in front of and to the rear of the opening 34**.

The U shaped base 24 is made of a rigid steel that is heat treated after it is formed so that the spacing between the legs 28, 30 is rigidly maintained. A center link 16 is inserted into the spacing between the legs 28, 30. With the rivet holes 36 of the center link aligned with rivet holes 38 in the base member legs 28, 30, a rivet 18 having a straight shaft or shank is forced through the holes to complete the inter-connection. In prior saw chain configurations, the rivets have a center section that fits the rivet hole of the center link but is larger in diameter than the rivet holes of the side links. This enlarged center section of the rivet spaces the side links apart for insuring free pivoting of the center link, i.e. it prevents the side links from pinching in on the center link. With the legs of the base member rigidly spaced by the connecting web, this manner of rivet induced spacing is no longer required and as described, the rivet 18 can be provided with a straight shank.

Figure 3:
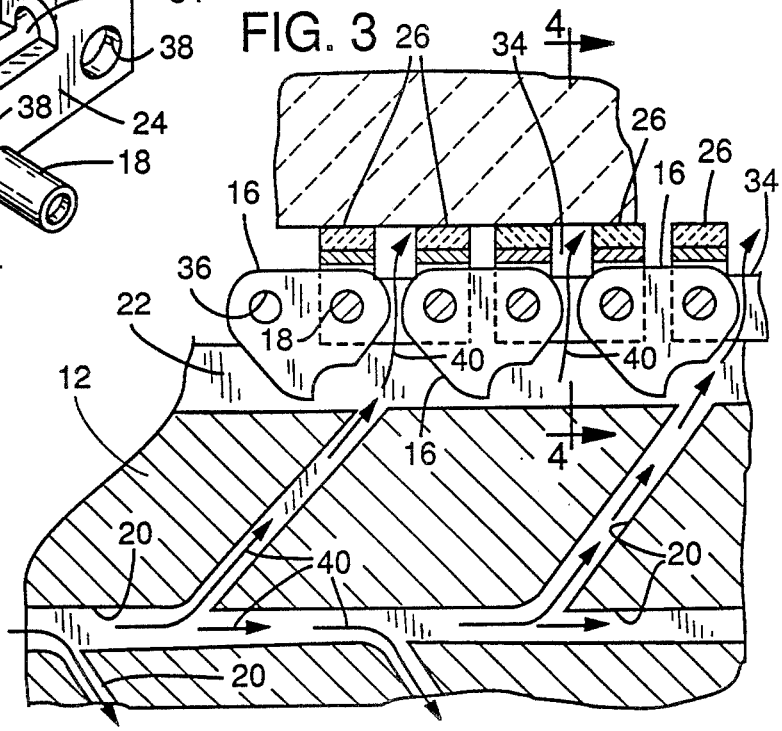
FIG. 3 is an enlarged view of a portion of the chain and guide bar of FIG. 1 in an aggregate cutting mode.
Figure 4:
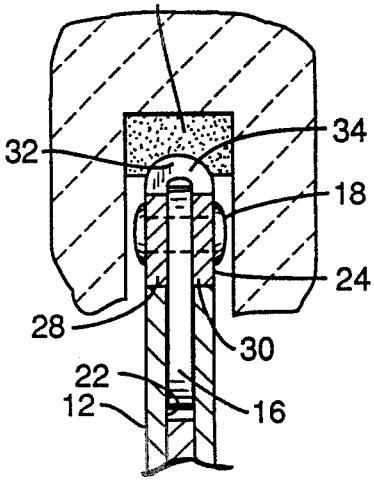
FIG. 4 is a section view taken on view lines 4—4 of FIG. 3.

In operation, the cutting link structure 14 with cutting block sections 26a, 26b perform with generally the same degree of stability as the prior cutting links having a full length cutting block. The increased supporting surface provided by the web 32 makes it easier to securely weld the cutting members 26 to the structure. The lateral forces acting on the two legs is fully absorbed by the base member as differentiated from the prior saw chain wherein the lateral forces were transmitted through the cutting block connection. As can be seen in FIG. 3, the opening 34 provides a passageway for the water flow indicated by arrow 40 for flushing out the kerf. As compared to the prior chain, and as shown in the drawings, cutting link structures can be provided at every side link position (a full house chain) although it will readily be understood that a skip tooth version (like that shown in the cited prior patent application) is just as easily constructed.

The present chain is cheaper to build than the prior chain, it cuts through the aggregate material with equal efficiency, it is more rugged, and it provides far better flushing of the bearing and cutting surfaces of the chain and bar components.

Certain modifications will become apparent to those skilled in the art without departing from the invention as defined in the claims appended hereto.

We claim:

1. A cutting link structure for cutting aggregate materials comprising;

an elongated base member formed into an inverted U shape having a pair of legs and a connecting web rigidly spacing the legs apart, cutting block means for cutting aggregate materials comprised of a front section affixed to one end of the connecting web and a rear section affixed to the other end of the connecting web, said cutting block means and connecting web having aligned center openings defining a passageway for a flushing liquid, and means for connecting the cutting link structure into an aggregate cutting chain comprised of a continuous loop of articulated saw chain links.

2. A cutting link structure as defined in claim 1 wherein the elongated base member is a plate folded into a U shape to form side plate portions as the legs and a bridging portion as the connecting web, said side plate portions having aligned front and rear rivet hole openings, the side plate portions spaced apart to receive saw chain center links inserted partially between the side plate portions front and back to be pivotally connected thereto by rivets projected through the front and rear rivet hole openings.

3. A cutting link structure for cutting aggregate materials comprising;

an elongated base member formed into an inverted U shape having a pair of legs and a connecting web rigidly spacing the legs apart, cutting block means for cutting aggregate materials, said cutting block means having a front section affixed to one end of the connecting web and a rear section affixed to the other end of the connecting web, said front and rear sections impregnated with diamond chips and the intermediate sections devoid of diamond chips, and means for connecting the cutting link structure into an aggregate cutting link chain comprised of a continuous loop of articulated links.

4. A cutting link structure as defined in claim 3 wherein an intermediate portion of the cutting block and the underlying intermediate portion of the connecting web are open to define a passageway for a flushing liquid.

5. A cutting link structure as defined in claim 4 wherein the elongated base member is a plate folded into a U shape to form side plate portions as the legs and a bridging portion as the connecting web, said side plate portions having aligned front and rear rivet hole openings, the side plate portions spaced apart to receive saw chain center links front and rear and to be pivotally connected thereto by rivets projected through the front and rear rivet hole openings.

6. A cutting chain for cutting aggregate materials comprising;

center links and cutting link structures, said cutting link structures having a plate-like base member folded into an elongated inverted U shape having front and rear ends and forming thereby a pair of side plate portions and a connecting web portion between the front and rear ends thereof to rigidly space the side plate portions apart, a center link inserted from each end into the spacing between the side plate portions, aligned rivet hole openings provided through the side plate portions and the inserted center links, and rivets projected through the aligned rivet hole openings to pivotally interconnect the cutting link structures and center links, and cutting block means affixed to the top at the front and rear ends of the connecting web.

7. A cutting chain as defined in claim 6 wherein the rivet hole openings in the side plate portions and center links have similar diameters and the rivets projected through the openings have straight shanks.

8. A cutting chain as defined in claim 7 wherein the cutting block means is comprised of front and rear sections affixed to front and rear sections of the connecting web, said cutting block means being a support matrix impregnated with diamond chips and a center section of the cutting block means being devoid of the diamond impregnated matrix.

9. A cutting chain as defined in claim 8 wherein the center section of the cutting block means and the underlying section of the connecting web is open and provides a passageway for a flushing liquid.

* * * * *